US005497594A

United States Patent [19]

Giuseppe et al.

[11] Patent Number: 5,497,594

[45] **Date of Patent: * Mar. 12, 1996**

[54] ADVANCED POLYMER AND WOOD FIBER COMPOSITE STRUCTURAL COMPONENT

[75] Inventors: Puppin Giuseppe, Bayport, Minn.; Michael J. Deaner, Osceola, Wis.; Kurt E. Heikkila, Circle Pines, Minn.

[73] Assignee: Andersen Corporation, Bayport, Minn.

[ * ] Notice: The portion of the term of this patent subsequent to Apr. 18, 2012, has been disclaimed.

[21] Appl. No.: 326,479

[22] Filed: Oct. 20, 1994

Related U.S. Application Data

[63] Continuation of Ser. No. 938,604, Sep. 1, 1992, Pat. No. 5,406,768.

[51] Int. Cl.[6] ..... F04C 3/46; F04C 2/26

[52] U.S. Cl. ..... 52/730.4; 52/730.3; 52/731.2

[58] Field of Search ..... 52/730.3, 730.4, 52/731.2, 731.4

[56] References Cited

U.S. PATENT DOCUMENTS

| | | |
|---|---|---|
| 2,188,396 | 1/1940 | Semon . |
| 2,489,373 | 11/1945 | Gilman . |
| 2,519,442 | 8/1950 | Delorme et al. . |
| 2,558,378 | 6/1951 | Petry . |
| 2,635,976 | 4/1953 | Meiler et al. . |
| 2,680,102 | 6/1954 | Becher . |
| 2,789,903 | 4/1957 | Lukman et al. . |

(List continued on next page.)

FOREIGN PATENT DOCUMENTS

| | | |
|---|---|---|
| 2270311 | 12/1975 | France . |
| 2365017 | 5/1978 | France . |
| 2445885 | 8/1980 | France . |
| 2564374 | 11/1985 | France . |
| 2042176 | 4/1971 | Germany . |
| 1443194 | 7/1976 | United Kingdom . |
| 2104903 | 3/1983 | United Kingdom . |
| 2171953 | 9/1986 | United Kingdom . |
| 2186655 | 9/1987 | United Kingdom . |
| WO90/08020 | 7/1990 | WIPO . |

OTHER PUBLICATIONS

Woodhams et al., "Wood Fibers as Reinforcing Fillers for Polyolefins", Polymer Engineering and Science, Oct. 1984, vol. 24, No. 15, pp. 1166–1171.

"Mechanical Properties of Wood", Revision by Bendtsen et al., pp. 4–2 through 4–44.

(List continued on next page.)

*Primary Examiner*—Michael Safavi
*Assistant Examiner*—Kevin D. Wilkens
*Attorney, Agent, or Firm*—Merchant, Gould, Smith, Edell, Welter & Schmidt

[57] ABSTRACT

An advanced composite structural component, made of a poller and wood fiber composite material, in the form of an extruded or injection molded thermoplastic member in residential and commercial structures. Preferably the structural component is used in a window or a door. Common window and door manufacture require the production of linear members with specifically designed cross-sectional shapes to form both the window frame structural elements and movable sash components. The structural elements must possess sufficient strength to permit the manufacture of a structurally sound window unit that can be readily installed into a rough opening and can cooperate with the wall structure to maintain structural integrity. The window or door should have sufficient strength to survive day-to-day use and abuse and to maintain window or door structural integrity after installation. The structural component has a hollow cross-section with at least one structural web and at least one fastener web formed within the component. The exterior of the extruded component is shaped and adapted for installation in a rough opening and to support window and door components. Such structural components have unique advantages and can be assembled in a thermoplastic weld process. Welding is performed by heating and fusing the heated surfaces together to form a welded joint having superior joint strength characteristics.

16 Claims, 1 Drawing Sheet

U.S. PATENT DOCUMENTS 2,926,729 3/1960 Zanini .
2,935,763 5/1960 Newman et al. .
3,147,518 9/1964 Horgan, Jr. .
3,287,480 11/1966 Wechsler et al. .
3,308,218 3/1967 Wiegand et al. .
3,309,444 3/1967 Schueler .
3,349,538 10/1967 Crossman .
3,492,388 1/1970 Inglin-Knosel .
3,493,527 2/1970 Schueler .
3,562,373 2/1971 Logrippo .
3,645,939 2/1972 Gaylord .
3,671,615 6/1972 Price .
3,844,081 10/1974 Hubbard et al. .
3,878,143 4/1975 Baumann et al. .
3,888,810 6/1975 Shinomura .
3,899,559 8/1975 Johnanson et al. .
3,904,726 9/1975 Jacquelin et al. .
3,931,384 1/1976 Forquer et al. .
3,943,079 3/1976 Hamed .
3,956,541 5/1976 Pringle .
3,956,555 5/1976 McKean .
3,969,459 7/1976 Fremont et al. .
4,005,162 1/1977 Bucking .
4,012,348 3/1977 Chelland et al. .
4,016,232 4/1977 Pringle .
4,018,722 4/1977 Baker .
4,033,913 7/1977 Sunden .
4,045,603 8/1977 Smith .
4,056,591 11/1977 Goettler et al. .
4,058,580 11/1977 Flanders .
4,071,479 1/1978 Broyde et al. .
4,097,648 6/1978 Pringle .
4,102,106 7/1978 Golder et al. .
4,115,497 9/1978 Halmo .
4,145,389 3/1979 Smith .
4,168,251 9/1979 Schinzel et al. .
4,181,764 1/1980 Totten .
4,187,352 2/1980 Klobbie .
4,203,876 5/1980 Dereppe et al. .
4,228,116 10/1980 Colombo et al. .
4,239,679 12/1980 Rolls et al. .
4,244,903 1/1981 Schnause .
4,248,743 2/1981 Goettler .
4,248,820 2/1981 Haataja .
4,250,222 2/1981 Mavel et al. .
4,263,184 4/1981 Leo et al. .
4,273,688 6/1981 Porzel et al. .
4,277,428 7/1981 Luck et al. .
4,281,039 7/1981 Miura et al. .
4,290,988 9/1981 Nopper et al. .
4,305,901 12/1981 Prince et al. .
4,311,554 1/1982 Herr .
4,311,621 1/1982 Nishizawa et al. .
4,328,136 5/1982 Blount .
4,376,144 3/1983 Goettler .
4,382,108 5/1983 Carroll et al. .
4,393,020 7/1983 Li et al. .
4,414,267 11/1983 Coran et al. .
4,420,351 12/1983 Lussi et al. .
4,426,470 1/1984 Wessling et al. .
4,440,708 4/1984 Haataja et al. .
4,454,091 6/1984 Chion et al. .
4,455,709 6/1984 Zanini .
4,481,701 11/1984 Hewitt .
4,491,553 1/1985 Yamada et al. .
4,503,115 3/1985 Hemels et al. .
4,505,869 3/1985 Nishibori .
4,506,037 3/1985 Suzuki et al. .
4,508,595 4/1985 Gasland .
4,551,294 11/1985 Wottka et al. .
4,562,218 12/1985 Fornadel et al. .
4,594,372 6/1986 Natov et al. .
4,597,928 7/1986 Terentiev et al. .
4,610,900 9/1986 Nishibori .
4,619,097 10/1986 Trummer et al. .
4,645,631 2/1987 Hegenstaller et al. .
4,659,754 4/1987 Edwards et al. .
4,663,225 5/1987 Farley et al. .
4,686,251 8/1987 Ostermann et al. .
4,687,793 8/1987 Motegi et al. .
4,716,062 12/1987 Klein .
4,734,236 3/1988 Davis .
4,737,532 4/1988 Fujita et al. .
4,769,109 9/1988 Tellvik et al. .
4,769,274 9/1988 Tellvik et al. .
4,774,272 9/1988 Lamphere et al. .
4,790,966 12/1988 Sandberg et al. .
4,818,604 4/1989 Tock .
4,820,763 4/1989 Yang .
4,851,458 7/1989 Hopperdietzel .
4,865,788 9/1989 Davis .
4,889,673 12/1989 Takimoto .
4,894,192 1/1990 Warych .
4,915,764 4/1990 Miani .
4,927,579 5/1990 Moore .
4,929,409 5/1990 Agren et al. .
4,935,182 6/1990 Ehner et al. .
4,960,548 10/1990 Ikeda et al. .
4,968,463 11/1990 Levasseur .
4,973,440 11/1990 Tamura et al. .
4,978,489 12/1990 Radvan et al. .
4,978,575 12/1990 Ziess .
4,988,478 1/1991 Held .
5,002,713 3/1991 Palardy et al. .
5,008,310 4/1991 Beshay .
5,009,586 4/1991 Pallmann .
5,021,490 6/1991 Vyvoda et al. .
5,049,334 9/1991 Bach .
5,057,167 10/1991 Gersbeck .
5,075,057 12/1991 Hoedl .
5,075,359 12/1991 Castagna et al. .
5,078,937 1/1992 Eela .
5,082,605 1/1992 Brooks et al. .
5,087,400 2/1992 Theuveny .
5,088,910 2/1992 Goforth et al. .
5,093,058 3/1992 Harmon et al. .
5,096,046 3/1992 Goforth et al. .
5,096,406 3/1992 Brooks et al. .

OTHER PUBLICATIONS

Maldas et al., "Composites of Polyvinyl Chloride—Wood Fibers: IV. Effect of the Nature of Fibers", Journal of Vinyl Technology, Jun. 1989, vol. 11, No. 2, pp. 90–98.Raj et al., "Use of Wood Fibers as Filler in Common Thermoplastic Studies on Mechanical Properties", Science and Engineering of Composite Materials, vol. 1, No. 3, 1989, pp. 85–98.

Kokta et al., "Use of Grafted Wood Fibers in Thermoplastic Composites V. Polystyrene", pp. 90–96.

Klason et al., "The Efficiency of Cellulosic Fillers in Common Thermoplastics. Part I. Filling Without Processing Aids or Coupling Agents" , International Journal of Polymeric Materials, Mar. 1984, pp. 159–187.

European Search Report dated Nov. 19, 1993.

Kokta et al., "Use of Wood Fibers in Thermoplastic Composites", Polymer Composites, Oct. 1983, vol. 4, No. 4, pp. 229–232.

Yam et al., "Composites From Compounding Wood Fibers With Recycled High Density Polyethylene", Polymer Engineering and Science, Mid– Jun. 1990, vol. 30, No. 11, pp. 693–699.
Zadorecki et al., "Future Prospects for Wood Cellulose as Reinforcement in Organic Polymer Composites", Polymer Composites, Apr. 1989, vol. 10, No. 2, pp. 69–77.
Dalvag et al., "The Efficiency of Cellulosic Fillers in Common Thermoplastics. Part II. Filling with Process Aids and Coupling Agents", International Journal of Polymeric Materials, 1985, vol. 11, pp. 9–38.
Rogalski et al., "Poly(Vinyl–Chloride) Wood Fiber Composites", Antec '87, pp. 1436–1441.
Raj et al., "Use of Wood Fibers in Thermosplastics. VII. The Effect of Coupling Agents in Polyethylene–Wood Fiber Composites", Journal of Applied Polymer Science, vol. 37, (1989), pp. 1089–1103.
Kokta et al., "Composites of Polyvinyl Chloride–Wood Fibers. I. Effect of Isocyanate as a Bonding Agent", Polym. Plast. Technol. Eng. 29(1&2), 1990, pp. 87–118.
Kokta et al., "Composites of Polyvinyl Chloride–Wood Fibers. III. Effect of Silane as Coupling Agent", Journal of Vinyl Technology, vol. 12, No. 3, pp. 146–153.
Kokta et al., "Composites of Poly(Vinyl Chloride) and Wood Fibers. Part II: Effect of Chemical Treatment", Polymer Composites, Apr. 1990, vol. 11, No. 2, pp. 84–89.
BFGoodrich, Geon Vinyl Divsion, Section One, FIBER-LOC®, Polymer Composites, Engineering Design Data Sheet, pp. 2–15.
"A Complete Guide to Andersen Windows & Patio Doors", 1992 Product Catalog.
European Search Report dated Nov. 10, 1993.
Database WPI, Week 8402, Derwent Publications Ltd., London, GB; AN 84–008707 & JP–A–58 204 049 (Ein Eng.), 28 Nov. 1983.
Database WPI, Week 8652, Derwent Publications Ltd., London, GB; AN 86–341745 & JP–A–61 236 858 (Chisso), 22 Oct. 1986.

ADVANCED POLYMER AND WOOD FIBER COMPOSITE STRUCTURAL COMPONENT

This is a continuation of application Ser. No. 07/938,604, filed Sep. 1, 1992, now U.S. Pat. No. 5,406,768 which application(s) are incorporated herein by reference.

FIELD OF THE INVENTION

The invention relates to structural components used in the fabrication of windows and doors for commercial and residential architecture. These structural components are made from a polyvinyl chloride and wood fiber composite. The composite can be made with an intentional recycle of by product streams comprising thermoplastic, adhesive, paint, preservatives, etc., common in window manufacture. More particularly, the invention relates to improved materials adapted for extrusion into the structural components of windows and doors that have improved properties when compared to either metal or to clad and unclad wooden components. The structural components of the invention can be used in the form of rails, jambs, stiles, sills, tracks, stop and sash. The structural components of the invention can be and fused to form high strength welded joints in window and door assembly.

BACKGROUND OF THE INVENTION

Conventional window and door manufacture has commonly used vinyl, wood and metal components in forming structural members.

Vinyl materials have been used in forming envelopes, trim and seal components in window units. Such vinyl materials typically comprise a major proportion of a vinyl polymer with inorganic pigment, fillers, lubricants, etc. Extruded or injection molded thermoplastic materials have been used in window and door manufacture. Filled and unfilled flexible and rigid thermoplastic materials have been extruded or injection molded into useful seals, trim components, fasteners, and other wood window construction parts.

Wood has been milled into shaped structural components that with glass can be assembled to form double hung or casement units, etc. and door assemblies. Wood windows, while structurally strong, useful and well adapted for use in many residential and commercial installations can have problems under certain circumstances related to the deterioration of the wood components. Wood windows also suffer from cost problems related to the availability of suitable wood for construction. Clear wood products are slowly becoming more scarce and are becoming more expensive as demand increases.

Metal, typically aluminum components, are also often combined with glass and formed into single unit sliding windows. Metal windows typically suffer from the drawback that they tend to lose substantial quantities of heat from interior spaces.

Thermoplastic polyvinyl chloride has been combined with wood members in manufacturing PERMASHIELD® brand windows manufactured by Andersen Corporation for many years. The technology disclosed in Zanini, U.S. Pat. Nos. 2,926,729 and 3,432,885, have been utilized in the manufacture of the plastic coatings or envelopes on wooden or other structural members. Generally, the cladding or coating technology used in making PERMASHIELD® windows involves extruding or injection molding a thin polyvinyl chloride coating or envelope onto a shaped wooden structural member. Polyvinyl chloride thermoplastic polymer materials have been combined with wood and wood fiber to make extruded or injection molded materials generally. However, the polyvinyl chloride materials of the prior art do not possess adequate properties to permit extrusion of structural members that are a direct replacement for wood. The polyvinyl chloride materials of the prior art do not have thermal and structural properties similar to wood members. The polymeric composites of the prior art fail to have sufficient compressive strength, modulus, coefficient of thermal expansion, coefficient of elasticity, workability or the ability to retain fasteners equivalent to or superior to wooden members. Further, many prior art extruded or injection molded composites must be milled to form a final useful shape. One class of composite, a polyvinyl chloride and wood flour material, poses the added problem that wood dust, which can accumulate during manufacture, tends to be explosive at certain concentrations of wood flour in the air.

Accordingly, a substantial need exists for an improved structural member that can be made of a polymer and wood fiber composite. The composite can contain an intentional recycle of a byproduct stream if desired. The composite can be extruded or injection molded into a shape that is a direct substitute in terms of assembly properties and structural properties, for the equivalent milled shape in a wooden structural member. The structural member requires a coefficient of thermal expansion that approximates wood, a material that can be extruded or injection molded into a reproducible stable dimension and a useful cross-section, a low heat transmission rate, an improved resistance to insect attack and rot while in use and a hardness and rigidity that permits sawing, milling and fastening retention comparable to wood members. Further, window and door manufacturers have become significantly sensitive to by-product streams produced in their manufacturing activities. Substantial quantities of wood by-product materials., including wood trim pieces, sawdust, wood milling gnawings; recycled thermoplastic including recycled polyvinyl chloride and other streams have caused significant expense to window manufacturers in disposal. Commonly, these materials are either burned for their heat value and electrical power generation or are shipped to qualified landfills for disposals. Such streams contain substantial proportions of hot melt and solvent-based adhesives, thermoplastics such as polyvinyl chloride, paint, preservatives and other organic materials. Substantial need exists to find a productive environmentally compatible use for such streams to avoid returning the materials into the environment in a harmful form.

BRIEF DISCUSSION OF THE INVENTION

We have found that the problems relating to forming a replacement for a wood structural member can be solved by forming structural members from a polymer and wood fiber composite material. The structural members of this invention are polymer and wood fiber extrusions having a useful cross-sectional shape that can be adapted to window or door construction and the installation of useful window components or parts into the structural member. The structural member can be an extrusion in the form or shape of a rail, jamb, stile, sill, track, stop or sash. Additionally, non-structural trim elements such as grid, cove, quarter-round, etc., can be made. The extruded or injection molded structural member comprises a hollow cross-section having a rigid exterior shell or wall, at least one internal structural or support web and at least one internal structural fastener anchor. The shell, web and anchor in cooperation have sufficient strength to permit the structural member to withstand normal wear and tear related to the operation of the window or door. Fasteners can be used to assemble the window or door unit. The fasteners must remain secure during window life to survive as a structural member or component of the residential or commercial architecture. We have further found that the structural members of the invention can be joined by fusing mating surfaces formed in the structural member at elevated temperature to form a welded joint having superior strength and rigidity when compared to prior art wooden members.

BRIEF DISCUSSION OF THE DRAWINGS

FIG. 1 is a perspective view from above showing an extruded or injection molded sill unit used in the base assembly of a sliding glass door having a stationary and moveable glass units. The sill contains an exterior shell or wall and interior structural webs with a fastener anchor web. These elements cooperate to provide superior strength, workability and fastener retention when compared to similarly sized wood members.

DETAILED DESCRIPTION OF THE INVENTION

Figure 1:
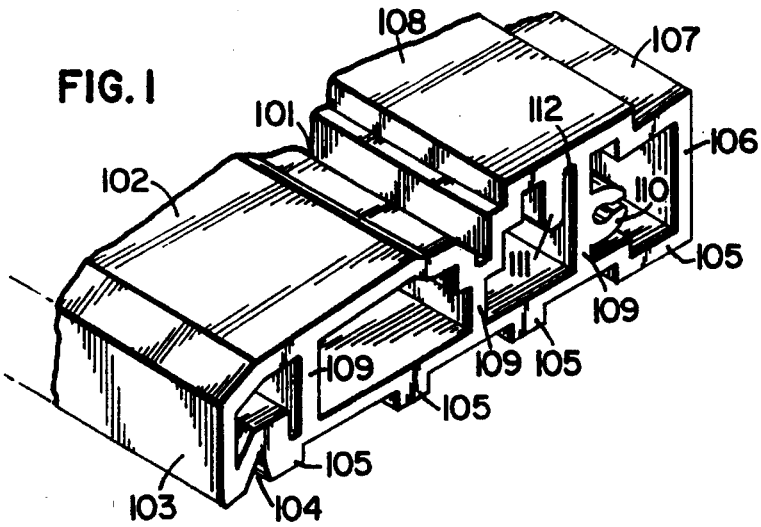

The invention resides in part in an extruded or injection molded structural member made from the thermoplastic polyvinyl chloride and wood fiber composite material. The composite material used in manufacturing the structural members of the invention is made from a combination of polyvinyl chloride and wood fiber. The polyvinyl chloride can be polyvinyl chloride homopolymer free of additional ingredients or it can be polyvinyl chloride homopolymer, copolymer, etc., polyvinyl chloride alloy or any of the polymeric materials compounded with additional additives. The sawdust can be virgin sawdust or can comprise sawdust recycled from the wood manufacturing process. Typically, the composition comprises from 50–70 wt-% of the polyvinyl chloride material combined with about 30–50 wt-% of the sawdust material. The preferred mode of practice of the invention uses approximately 60 wt-% polyvinyl chloride with 40 wt-% sawdust. The extruded or injection molded member is a linear member with a hollow profile.

The profile comprises an exterior wall or shell substantially enclosing a hollow interior. The interior can contain at least one structural web providing support for the walls and can contain at least one fastener anchor Web to ensure that the composite member can be attached to other members using commonly available fasteners which are strongly retained by the fastener anchor web.

The structural member is typically shaped by the extrusion or injection molding process such that the member can replace a structural or trim component of existing window or door manufacture. Such structural members can take a variety of shapes which surface contours are adapted to the window or door assembly process and are adapted to the operation of working parts of the window or door. Such structural members can contain screen insert supports, sliding window or sliding door supports, cut-outs for hardware installation, anchor locations, etc. The thermoplastic composite material typically forms a shell or wall exterior substantially surrounding the interior space. The exterior shell or wall contains a surface shaped as needed to assemble the window and surfaces needed for cooperation with the other working parts of the window and the rough opening as described above.

The interior of the structural member is commonly provided with one or more structural webs which in a direction of applied stress supports the structure. Structural web typically comprises a wall, post, support member, or other formed structural element which increases compressive strength, torsion strength, or other structural or mechanical properties. Such structural web connects the adjacent or opposing surfaces of the interior of the structural member. More than one structural web can be placed to carry stress from surface to surface at the locations of the application of stress to protect the structural member from crushing, torsional failure or general breakage. Typically, such support webs are extruded or injection molded during the manufacture of the structural material. However, a support can be post added from parts made during separate manufacturing operations.

The internal space of the structural member can also contain a fastener anchor or fastener installation support. Such an anchor or support means provides a locus for the introduction of a screw, nail, bolt or other fastener used in either assembling the unit or anchoring the unit to a rough opening in the commercial or residential structure. The anchor web typically is conformed to adapt itself to the geometry of the anchor and can simply comprise an angular opening in a formed composite structure, can comprise opposing surfaces having a gap or valley approximately equal to the screw thickness, can be geometrically formed to match a key or other lock mechanism, or can take the form of any commonly available automatic fastener means available to the window manufacturer from fastener or anchor parts manufactured by companies such as Amerock Corp., Illinois Tool Works and others.

The structural member of the invention can have premolded paths or paths machined into the molded thermoplastic composite for passage of door or window units, fasteners such as screws, nails, etc. Such paths can be counter sunk, metal lined, or otherwise adapted to the geometry or the composition of the fastener materials. The structural member can have mating surfaces premolded in order to provide rapid assembly with other window. components of similar or different compositions having similarly adapted mating surfaces. Further, the structural member can have mating surfaces formed in the shell of the structural member adapted to moveable window sash or door sash or other moveable parts used in window operations.

The structural member of the invention can have a mating surface adapted for the attachment of the weigh subfloor or base, framing studs or side molding or beam, top portion of the structural member to the rough opening. Such a mating surface can be flat or can have a geometry designed to permit easy installation, sufficient support and attachment to the rough opening. The structural member shell can have other surfaces adapted to an exterior trim and interior mating with wood trim pieces and other surfaces formed into the exposed sides of the structural member adapted to the installation of metal runners, wood trim parts, door runner supports, or other metal, plastic, or wood members commonly used in the assembly of windows and doors.

Different components of the structural members of windows and doors have different physical requirements for a stable installation. The minimum compressive strength for a weight bearing sill member must be at least 1500 lbs., preferably 2000 lbs. The compressive strength is typically measured in the direction that load is normally placed on the member. The direction can be a normal force or a force directed along the axis of the unit when installed in the side frame or base of a window or door. The Youngs modulus of a vertical jamb or stile in a window or door should be at least 500,000 psi, preferably 800,000 and most preferably $10^6$ psi. We have found that the coefficient of thermal expansion of the polymer and wood fiber composite material is a reasonable compromise between the longitudinal coefficient of thermal expansion of PVC which is typically about $4\times10^{-5}$ in./in.°F. and the thermal expansion of wood in the transverse direction which is approximately $0.2\times10^{-5}$ in./in.°F. Depending upon the proportions of materials and the degree to which the materials are blended and uniform, the coefficient of thermal expansion of the material can range from about 1.5 to $3.0\times10^{-5}$ , preferably about 1.6 to $1.8\times10^{-5}$ in./in.°F.

The structural members of the invention can be assembled with a variety of known mechanical fastener techniques. Such techniques include screws, nails, and Other hardware. The structural members of the invention can also be joined by an insert into the hollow profile, glue, or a melt fusing technique wherein a fused weld is formed at a joint between two structural members. The structural members can be cut or milled to form conventional mating surfaces including 90° angle joints, rabbit joints, tongue and groove joints, butt joints, etc. Such joints can be bonded using an insert placed into the hollow profile that is hidden when joinery is complete. Such an insert can be glued or thermally welded into place. The insert can be injection molded or formed from similar thermoplastics and can have a service adapted for compression fitting and secure attachment to the structural member of the invention. Such an insert can project from approximately 1 to 5 inches into the hollow interior of the structural member. The insert can be shaped to form a 90° angle, a 180° extension, or other acute or obtuse angle required in the assembly of the structural member. Further, such members can be manufactured by milling the mating faces and gluing members together with a solvent, structural or hot melt adhesive. Solvent borne adhesives that can act to dissolve or soften thermoplastic present in the structural member and to promote solvent based adhesion or welding of the materials are known in polyvinyl chloride technology. In the welding technique, once the joint surfaces are formed, the surfaces of the joint can be heated to a temperature above the melting point of the composite material and while hot, the mating surfaces can be contacted in a configuration required in the assembled structure. The contacted heated surfaces fuse through an intimate mixing of molten thermoplastic from each surface. Once mixed, the materials cool to form a structural joint having strength typically greater than joinery made with conventional techniques. Any excess thermoplastic melt that is forced from the joint area by pressure in assembling the surfaces can be removed using a heated surface, mechanical routing or a precision knife cutter.

DETAILED DESCRIPTION OF THE DRAWINGS

FIG. 1 is a perspective view from above of an extruded or injection molded sill member of the invention. The sill is adapted for installation into the base or support for the door frame. Hinged glass doors (not shown) are stopped on an aluminum sill (not shown) having grooved runners supporting the glass door panel. The aluminum sill can be snap-fit onto the extruded sill by installation onto the extruded sill at a snap-fit attachment groove 101. The aluminum piece covers the sill from the groove 101 over the snap-fit land 102, the exterior face 103 ending in the snap-fit groove 104 for a mechanically secure attachment. The sill rests on the subfloor supported by the sill rests 105. The interior installation face 106 abuts subflooring or trim additional components of the assembled sliding door unit. After the sliding door is installed an oak threshold is installed onto the oak threshold lands 107 and 108. The oak threshold has faces milled to match the threshold land areas. The interior of the sill shows vertical support webs 109. The support webs 109 provide compression strength supporting the top of the sill, the snap-fit lands 102 and the oak threshold lands 107 and 108. The-sill also includes a C-shaped fastener anchor 110 which is molded integrally with the support web 109. The typical fastener such as a screw can pass into the anchor space in the anchor 110. An additional attachment web 111 is coextruded with the oak threshold land 109 providing an attachment anchor valley 112 for screws passing vertically through the oak threshold land 108 into the valley screw anchor 112.

Figure 2:
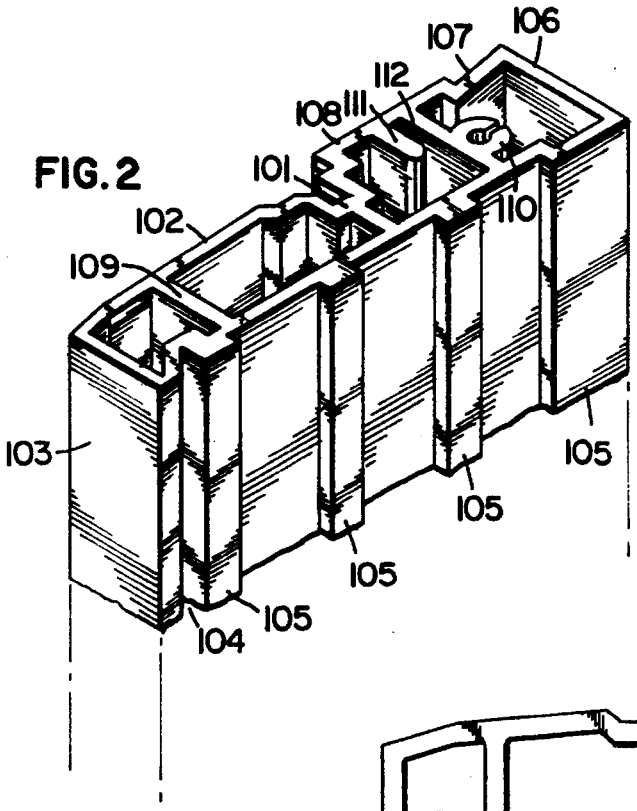
FIG. 2 is a perspective view from below showing the sill unit.

FIG. 2 shows a perspective view from below of an extruded sill member as shown in FIG. 1. The snap-fit attachment groove 101 for the aluminum sill, the snap-fit land 102 and the exterior face 103 is shown. The snap-fit groove 104 is shown on the bottom view. The sill rest members 105 are shown in the bottom view of the sill. The interior installation face 106 is hidden from sight. The oak threshold lands 107 and 108 are also hidden from view. The vertical support webs 109 are shown providing support for the oak threshold lands 107 and 108 and the snap-fit land 102. The fastener anchor 110 the vertical anchor web 111 and the fastener anchor valley 112 are also shown in the figure.

Figure 3:
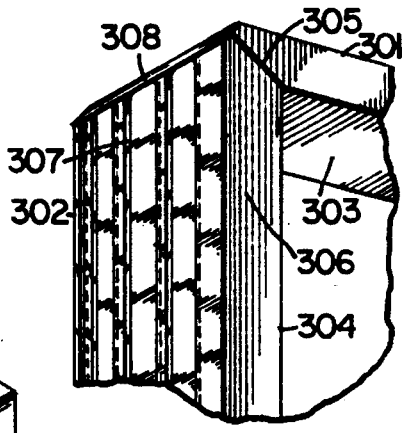
FIG. 3 is a perspective view from the side of a welded joint between two structural units. Two extruded composite structural members are joined at a 90° angle using a welded or fused joint between the members.

FIG. 3 is a perspective view from the side of a welded corner of a joint between two structural members that can be the exterior framing portion of a window or door unit. The top portion 301 and the wall portion 302 can be installed into a rough framed opening (not shown). The interior top surface 303 and 304 can have, installed plastic, wood or metal components for window or door operation. Such components can be sealed, weather stripped or similarly fixed in place. The structural integrity of the unit is obtained by welding the units at the weld line 305 which comprises a fused area that extends from the interior face 306 through the exterior face 307. The weld is finished using a heated tool mechanical routing or precision knife to create a surface 308 that forms an attractive finished look by heating the joined area on the exterior corner of the fused zone. Any irregularity caused by the expulsion of melted material from the fused zone is smoothed by forming the surface 308.

We have found that joining of structural members can be accomplished using a melt fuse process. In the production of the joint shown in FIG. 3, the extruded member is first mitered to form a 45° cut. The mitered surface is then contacted with a heated member for sufficient period to melt the mitered joint to a depth of about 2 mm. The melt reaches a temperature greater than about the melting point of the thermoplastic (i.e.,) about 225° C. or more. A similar procedure is performed on the mating mitered surface. The melt mitered surfaces are joined in a fixed 90° angle position and pressure is placed on the members until the melt mitered surfaces form a fused joint. The materials are held in place until the fused joint cools, solidifies and becomes mechanically sound. The formed joint is then removed from any mechanical restraints.

Figure 4:
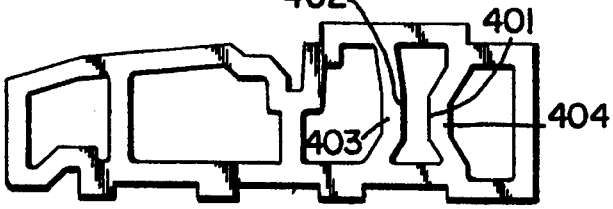
FIG. 4 is an elevation of a different embodiment of the sill member of the invention having a fastener anchor web of an alternative design.

FIG. 4 is an elevation of the structural member of the invention with an alternative fastener anchor. The member is identical to the member of FIG. 2 except in the fastener anchor. In FIG. 4, a first anchor surface 401 and a second anchor surface 402 is used. These surfaces are included in webs 403 and 404 which act as support webs.

The structural member of the invention can be manufactured using any typical thermoplastic forming operation. Preferred forming processes include extrusion and injection molding.

Pellet

The polyvinyl chloride and wood fiber can be combined and formed into a pellet using a thermoplastic extrusion process. A linear extrudate is similar to a pellet except the extrudate is not left in a linear format and is cut into discrete pellet units. Wood fiber can be introduced into a pellet making process in a number of sizes. We believe that the wood fiber should have a minimum size of length and width of at least 1 mm because smaller particles produce reduced physical properties in the member and because wood flour tends to be explosive at certain wood to air ratios. Further, wood fiber of appropriate size and an aspect ratio greater than 1 tends to increase the physical properties of the extruded structural member. However, useful structural members can be made with a fiber of very large size. Fibers that are up to 3 cm in length and 0.5 cm in thickness can be used as input to the pellet or linear extrudate manufacturing process. However, particles of this size do not produce highest surface quality structural members or maximized strength. The best appearing product with maximized structural properties are manufactured within a range of particle size as set forth below. Further, large particle wood fiber can be reduced in size by grinding or other similar processes that produce a fiber similar to sawdust having the stated dimensions and aspect ratio. One further advantage of manufacturing sawdust of the desired size is that the fiber material can be pre-dried before introduction into the pellet or linear extrudate manufacturing process.

The polyvinyl chloride and wood fiber are intimately contacted to form the composite material at high temperatures and pressures to insure that the wood fiber and polymeric material are wetted, mixed and extruded in a form such that the polymer material, on a microscopic basis, coats and flows into the pores, cavities, etc., of the fibers.

The fibers are preferably oriented by the extrusion process in the extrusion direction. Such orientation causes overlapping of adjacent parallel fibers and polymeric coating of the oriented fibers resulting a material useful for manufacture of improved structural members with improved physical properties. The structural members have substantially increased strength and tensile modulus with a coefficient of thermal expansion and a modulus of elasticity that is optimized for window and doors. The properties are a useful compromise between wood, aluminum and neat polymer.

Moisture control is an important element of manufacturing a useful linear extrudate or pellet. Depending on the equipment used and processing conditions, controlling in the water content of the linear extrudate or pellet can be important in forming a successful structural member substantially free of internal voids or surface blemishes. Water present in the sawdust during the formation of pellet or linear extrudate when heated can flash from the surface of the newly extruded structural member and can come as a result of a rapid volatilization, form a steam bubble deep in the interior of the extruded member which can pass from the interior through the hot thermoplastic extrudate leaving a substantial flaw. In a similar fashion, surface water can bubble and leave cracks, bubbles or other surface flaws in the extruded member.

Trees when cut, depending on relative humidity and season, can contain from 30 to 300 wt-% water based on fiber content. After rough cutting and finishing into sized lumber, seasoned wood can have a water content of from 20 to 30 wt-% based on fiber content. Kiln dried sized lumber cut to length can have a water content typically in the range of 8 to 12%, commonly 8 to 10 wt-% based on fiber. Some wood source, such as poplar or aspen, can have increased moisture content while some hard woods can have reduced water content.

Because of the variation in water content of wood fiber source and the sensitivity of extrudate to water content control of water to a level of less than 8 wt-% in the pellet based on pellet weight is important. Structural members extruded in non-vented extrusion process, the pellet should be as dry as possible and have a water content between 0.01 and 5 wt-%, preferably about 0.1 to 3.5 wt-%. When using vented equipment in manufacturing the extruded linear member, a water content of less than 8 wt-% can be tolerated if processing conditions are such that vented extrusion equipment can dry the thermoplastic material prior to the final formation of the structural member at the extrusion head.

The pellets or linear extrudate of the invention are made by extrusion of the polyvinyl chloride and wood fiber composite through an extrusion die resulting in a linear extrudate that can be cut into a pellet shape. The pellet cross-section can be any arbitrary shape depending on the extrusion die geometry. However, we have found that a regular geometric cross-sectional shape can be useful. Such regular cross-sectional shapes include a triangle, a square, a rectangle, a hexagonal, an oval, a circle, etc. The preferred shape of the pellet is a regular cylinder having a roughly circular or somewhat oval cross-section. The pellet volume is preferably greater than about 12 $mm^3$. The preferred pellet is a right circular cylinder, the preferred radius of the cylinder is at least 1.5 mm with a length of at least 1 mm. Preferably, the pellet has a radius of 1 to 5 mm and a length of 1 to 10 mm. Most preferably, the cylinder has a radius of 2.3 to 2.6 mm, a length of 2.4 to 4.7 mm, a volume of 40 to 100 $mm^3$, a weight of 40 to 130 mg and a bulk density of about 0.2 to 0.8 $gm/mm^3$. The linear extrudate is similar to the pellet in dimensions except the length is indeterminate.

We have found that the interaction, on a microscopic level, between the polymer mass and the wood fiber is an important element of the invention. We have found that the physical properties of an extruded member are improved when the polymer melt during extrusion of the pellet or linear member thoroughly wets and penetrates the wood fiber particles. The thermoplastic material comprises an exterior continuous organic polymer phase with the wood particle dispersed as a discontinuous phase in the continuous polymer phase. The material during mixing and extrusion produces an aspect ratio of at least 1.1 and preferably between 2 and 4, optimizes orientation such as at least 20%, preferably 40% of the fibers are oriented, above random orientation of 40–50%, in an extruder direction and are thoroughly mixed and wetted by the polymer such that all exterior surfaces of the wood fiber are in contact with the polymer material. This means, that any pore, crevice, crack, passage way, indentation, etc., is fully filled by thermoplastic material. Such penetration is attained by ensuring that the viscosity of the polymer melt is reduced by operations at elevated temperature and the use of sufficient pressure to force the polymer into the available internal pores, cracks and crevices in and on the surface of the wood fiber.

During the pellet or linear extrudate manufacture, substantial work is done in providing a uniform dispersion of the wood into the polymer material. Such work produces substantial orientation which when extruded into a final structural member, permits the orientation of the fibers in the structural member to be increased in the extruder direction resulting in improved structural properties in the sense of compression strength in response to a normal force or in a torsions or flexing mode.

The pellet dimensions are selected for both convenience in manufacturing and in optimizing the final properties of the extruded materials. A pellet that has dimensions substantially less than the dimensions set forth above are difficult to extrude, pelletize and handle in storage. Pellets larger than the range recited are difficult to cool, introduce into extrusion equipment, melt and extrude into a finished structural member.

Polyvinyl Chloride Homopolymer, Copolymers and Polymeric Alloys

Polyvinyl chloride is a common commodity thermoplastic polymer. Vinyl chloride monomer is made from a variety of different processes such as the reaction of acetylene and hydrogen chloride and the direct chlorination of ethylene. Polyvinyl chloride is typically manufactured by the free radical polymerization of vinyl chloride resulting in a useful thermoplastic polymer. After polymerization, polyvinyl chloride is commonly combined with thermal stabilizers, lubricants, plasticizers, organic and inorganic pigments, fillers, biocides, processing aids, flame retardants and other commonly available additive materials. Polyvinyl chloride can also be combined with other vinyl monomers in the manufacture of polyvinyl chloride copolymers. Such copolymers can be linear copolymers, branched copolymers, graft copolymers, random copolymers, regular repeating copolymers, block copolymers, etc. Monomers that can be combined with vinyl chloride to form vinyl chloride copolymers include a acrylonitrile, alpha-olefins such as ethylene, propylene, etc., chlorinated monomers such as vinylidene dichloride, acrylate momoners such as acrylic acid, methylacrylate, methylmethacrylate, acrylamide, hydroxyethyl acrylate, and others, styrenic monomers such as styrene, alphamethyl styrene, vinyl toluene, etc.; vinyl acetate; and other commonly available ethylenically unsaturated monomer compositions. Such monomers can be used in an amount of up to about 50 mol-%, the balance being vinyl chloride. Polymer blends or polymer alloys can be useful in manufacturing the pellet or linear extrudate of the invention. Such alloys typically comprise two miscible polymers blended to form a uniform composition. Scientific and commercial progress in the area of polymer blends has lead to the realization that important physical property improvements can be made not by developing new polymer material but by forming miscible polymer blends or alloys. A polymer alloy at equilibrium comprises a mixture of two amorphous polymers existing as a single phase of inability mixed segments of the two macro molecular components. Miscible amorphous polymers form glasses upon sufficient cooling and a homogeneous or miscible polymer blend exhibits a single, composition dependent glass transition temperature ($T_g$), or as an immiscible or non-alloyed blend of polymers typically displays two or more glass transition temperatures associated with immiscible polymer phase. In the simplest cases, the properties of polymer alloys reflect a composition weighted average of properties possessed by the components. In general, however, the property dependence on composition varies in a complex way with a particular property, the nature of the components (glassy, rubbery or semi-crystalline), the thermodynamic state of the blend, and its mechanical state whether molecules and phases are oriented. Polyvinyl chloride forms a number of known polymer alloys including, for example, polyvinyl chloride/nitrile rubber; polyvinyl chloride and related chlorinated copolymers and terpolymers of polyvinyl chloride or vinylidine dichloride; polyvinyl chloride/alphamethyl styrene-acrylonitrile copolymer blends; polyvinyl chloride/polyethylene; polyvinyl chloride/chlorinated polyethylene and others.

The primary requirement for the substantially thermoplastic polymeric material is that it retain sufficient thermoplastic properties to permit melt blending with wood fiber, permit formation of linear extrudate pellets, and to permit the composition material or pellet to be extruded in a thermoplastic process forming the rigid structural member. Polyvinyl chloride homopolymers, copolymers and polymer alloys are available from a number of manufacturers including B. F. Goodrich, Vista, Air Products, Occidental Chemicals, etc. Preferred polyvinyl chloride materials are polyvinyl chloride homopolymer having a molecular weight of about 90,000±50,000, most preferably about 88,000±10,000.

Wood Fiber

Wood fiber, in terms of abundance and suitability can be derived from either soft woods or evergreens or from hard woods commonly known as broad leaf deciduous trees. Soft woods are generally preferred for fiber manufacture because the resulting fibers are longer, contain high percentages of lignin and lower percentages of hemicellulose than hard woods. While soft wood is the primary source of fiber for the invention, additional fiber make-up can be derived from a number of secondary or fiber reclaim sources including bamboo, rice, sugar cane, and recycled fibers from newspapers, boxes, computer printouts, etc.

However, the primary source for wood fiber of this invention comprises the wood fiber by-product of sawing or milling soft woods commonly known as sawdust or milling tailings. Such wood fiber has a regular reproducible shape and aspect ratio. The fibers based on a random selection of about 100 fibers are commonly at least 1 mm in length, 3 mm in thickness and commonly have an aspect ratio of at least 1.8. Preferably, the fibers are 1 to 10 mm in length, 0.3 to 1.5 mm in thickness with an aspect ratio between 2 and 7, preferably 2.5 to 6.0. The preferred fiber for use in this invention are fibers derived from processes common in the manufacture of windows and doors. Wooden members are commonly ripped or sawed to size in a cross grain direction to form appropriate lengths and widths of wood materials. The by-product of such sawing operations is a substantial quantity of sawdust. In shaping a regular shaped piece of wood into a useful milled shape, wood is commonly passed through machines which selectively removes wood from the piece leaving the useful shape. Such milling operations produce substantial quantities of sawdust or mill tailing by-products. Lastly, when shaped materials are cut to size and mitered joints, butt joints, overlapping joints, mortise and tenon joints are manufactured from pre-shaped wooden members, substantial trim is produced. Such large trim pieces are commonly cut and machined to convert the larger objects into wood fiber having dimensions approximating sawdust or mill tilling dimensions. These materials can be dry blended to form input to the pelletizing function. Further, the streams can be pre-mitered to the preferred particle size of sawdust or can be post-milled.

Such sawdust material can contain substantial proportions of a by-product stream. Such by-products include polyvinyl chloride or other polymer materials that have been used as coating, cladding or envelope on wooden members; recycled structural members made from thermoplastic materials such as polyethylene, polypropylene, polystyrene, polyethylene terephthalate, etc.; polymeric materials from coatings; adhesive components in the form of hot melt adhesives, solvent based adhesives, powdered adhesives, etc.; paints including water based paints, alkyd paints, epoxy paints, etc.; preservatives, anti-fungal agents, anti-bacterial agents, insecticides, etc., and other streams common in the manufacture of wooden doors and windows. The total by-product stream content of the wood fiber materials is commonly less than 25 wt-% of the total wood fiber input into the polyvinyl chloride wood fiber product. Of the total recycle, approximately 10 wt-% of that can comprise a vinyl polymer commonly polyvinyl chloride. Commonly, the intentional recycle ranges from about 1 to about 25 wt-%, preferably about 2 to about 20 wt-%, most commonly from about 3 to about 15 wt-% of contaminants based on the sawdust.

Moisture Control

Food fiber, sawdust, has a substantial proportion of water associated with the fiber. Water naturally is incorporated in the growth cycle of living wood. Such water remains in the wood even after substantial drying cycles in lumber manufacture. In seasoned finished lumber used in the manufacture of wooden structural members, the sawdust derived from such operations can contain about 20% water or less. We have found that control of the water common in wood fibers used in the polyvinyl chloride/wood fiber composite materials and pellet products of the invention is a critical aspect to obtaining consistent high quality surface finish and dimensional stability of the PVC/wood fiber composite structural members. During the manufacture of the pellet material, we have found that the removal of substantial proportion of the water is required to obtain a pellet optimized for further processing into the structural members. The maximum water content of the polyvinyl chloride/wood fiber composition or pellet is 10 wt-% or less, preferably 8.0 wt-% or less and most preferably the composition or pellet material contains from about 0.01 to 3.5 wt-% water. Preferably, the water is removed after the material is mixed and formed into an extrusion prior to cutting into pellets. At this stage, water can be removed using the elevated temperature of the material at atmospheric pressure or at reduced pressure to facilitate water removal. The production can be optimized to result in substantial control and uniformity of water in the pellet product.

Composition and Pellet Manufacture

In the manufacture of the composition and pellet of the invention, the manufacture and procedure requires two important steps, a first blending step and a second pelletizing step.

During the blending step, the polymer and wood fiber are intimately mixed by high shear mixing components with recycled material to form a polymer wood composite wherein the polymer mixture comprises a continuous organic phase and the wood fiber with the recycled materials forms a discontinuous phase suspended or dispersed throughout the polymer phase. The manufacture of the dispersed fiber phase within a continuous polymer phase requires substantial mechanical input. Such input can be achieved using a variety of mixing means including preferably extruder mechanisms wherein the materials are mixed under conditions of high shear until the appropriate degree of wetting and intimate contact is achieved. After the materials are fully mixed, the moisture content must be controlled at a moisture removal station. The heated composite is exposed to atmospheric pressure or reduced pressure at elevated temperature for a sufficient period of time to remove moisture resulting in a final moisture content of about 8 wt-% or less. Lastly, the polymer fiber is aligned and extruded into a useful form.

The preferred equipment for mixing and extruding the composition and wood pellet of the invention is an industrial extruder device. Such extruders can be obtained from a variety of manufacturers including Cincinnati Millicron, etc.

The materials feed to the extruder can comprise from about 30 to 50 wt-% of sawdust including recycled impurity along with from about 50 to 70 wt-% of polyvinyl chloride polymer compositions. Preferably, about 35 to 45 wt-% wood fiber or sawdust is combined with 65 to 55 wt-% polyvinyl chloride homopolymer. The polyvinyl chloride feed is commonly in a small particulate size which can take the form of flake, pellet, powder, etc. Any polymer form can be used such that the polymer can be dry mixed with the sawdust to result in a substantially uniform pre-mix. The wood fiber or sawdust input can be derived from a number of plant locations including the sawdust resulting from rip or cross grain sawing, milling of wood products or the intentional commuting or fiber manufacture from wood scrap. Such materials can be used directly from the operations resulting in the wood fiber by-product or the by-products can be blended to form a blended product. Further, any wood fiber material alone, or in combination with other wood fiber materials, can be blended with a by-product stream from the manufacturer of wood windows as discussed above. The wood fiber or sawdust can be combined with other fibers and recycled in commonly available particulate handling equipment.

Polymer and wood fiber are then dry blended in appropriate proportions prior to introduction into blending equipment. Such blending steps can occur in separate powder handling equipment or the polymer fiber streams can be simultaneously introduced into the mixing station at appropriate feed ratios to ensure appropriate product composition.

In a preferred mode, the wood fiber is placed in a hopper, controlled by weight or by volume, to meter the sawdust at a desired volume while the polymer is introduced into a similar hopper have a volumetric metering input system. The volumes are adjusted to ensure that the composite material contains appropriate proportions on a weight basis of polymer and wood fiber. The fibers are introduced into a twin screw extrusion device. The extrusion device has a mixing section, a transport section and an extruder section. Each section has a desired heat profile resulting in a useful product. The materials are introduced into the extruder at a rate of about 600 to about 1000 pounds of material per hour and are initially heated to a temperature of about 215°–225° C. In the intake section, the stage is maintained at about 215° C. to 225° C. In the mixing section, the temperature of the twin screw mixing stage is staged beginning at a temperature of about 205°–215° C. leading to a final temperature in the melt section of about 195°–205° C. at spaced stages. One the material leaves the blending stage, it is introduced into a three stage extruder with a temperature in the initial section of 185°–195° C. wherein the mixed thermoplastic stream is divided into a number of cylindrical streams through a head section and extruded in a final zone of 195°–200° C. Such head sections can contain a circular distribution of 10 to 500, preferably 20 to 250 orifices having a cross-sectional shape leading to the production of a regular cylindrical pellet. As the material is extruded from the head it is cut with a knife at a rotational speed of about 100 to 400 rpm resulting in the desired pellet length.

The composite thermoplastic material is then extruded or injection molded into the structural members of the invention. Preferably, the composite composition is in the form of a pellet or linear extrudate which is directed into the extrusion or injection molding apparatus. In extruder operations, the pellet materials of the invention are introduced into an extruder and extruded into the structural member of the invention. The extruder can be any conventional extruder equipment including Moldavia, Cincinnati Millicon Extruders, etc. Preferably, parallel twin screw extruders having an appropriate shaped four zone barrel are used. The extrudate product is typically extruded into a cooling water tank at a rate of about 4 feet of structural member per minute. A vacuum gauged device can be used to maintain accurate dimensions in the extrudate. The melt temperature in the extruder can be between 390°–420° F. The melt in the extruder is commonly vented to remove water and the vent is operated at vacuum of not less than 3 inches of mercury. The extruder barrel has zones of temperature that decrease from a maximum of about 240° C. to a minimum of 180°–190° C. and four successive heating zones or steps.

Similarly, the structural members of the invention can be manufactured by injection molding. Injection molding processes inject thermoplastic materials at above the melt point under pressure into molds having a shape desired for the final molded products. The machines can be either reciprocating or two stage screw driven. Other machines that can be used are plunger mechanisms. Injection molding produces parts in large volume with close tolerances. Parts can be molded in combination of thermoplastic materials with glass, asbestos, taal carbon, metals and non-metals, etc. In injection molding, material is fed from a hopper into a feed shoot into the mechanism used in the individual injection molding apparatus to melt and place the melt injection material under pressure. The mechanism then uses a reciprocating screw, plunger or other injection means to force the melt under pressure into the mold. The pressure forces the material to take a shape substantially identical to that of the mold interior.

Experimental

Using the methods for manufacturing a pellet and extruding the pellet into a structural member, an extruded piece as shown in FIGS. 1 and 2 of the application were manufactured. The overall width of the unit was about 3.165 in.× 1.062 in. in height. The wall thickness of any of the elements of the extrudate was about 0.120 inches. A Cincinnati Millicon extruder with an HP barrel, a Cincinnati pelletizer screws, and AEG K-20 pelletizing head with 260 holes, each hole having a diameter of about 0.0200 inches was used to make a pellet. The input to the pelletizer comprise approximately 60 wt-% polymer and 40 wt-% sawdust. The polymer material comprises a thermoplastic mixture of approximately 100 parts of vinyl chloride homopolymer, about 15 parts titanium dioxide, about 2 parts ethylene-bis-stearimide wax lubricant, about 1.5 parts calcium stearate, about 7.5 parts Rohm & Haas 980-T acrylic resin impact modifier/process aid and about 2 parts of dimethyl tin thioglycolate. The sawdust input comprises a wood fiber particle containing about 5 wt-% recycled polyvinyl chloride having a composition substantially identical to the polyvinyl chloride recited above. The initial melt temperature of the extruder was maintained between 375° C. and 425° C. The pelletizer was operated on a vinyl/sawdust combined ratio through put of about 800 pounds/hour. In the initial extruder feed zone, the barrel temperature was maintained between 215°–225° C. In the intake zone, the barrel was maintained at 215°–225° C., and the compression zone was maintained at between 205°– 215° C. and in the melt zone the temperature was maintained at 195°–205° C. The die was divided into three zones, the first zone at 185°–195° C., the second zone at 185°–195° C. and in the final die zone 195°–205° C. The pelletizing head was operated at a setting providing 100–300 rpm resulting in a pellet with a diameter of about 5 mm and a length as shown in the following Table.

In a similar fashion, the sill of FIGS. 1 and 2 was extruded from a vinyl wood composite pellet using an extruder within an appropriate extruder die. The melt temperature of the input to the machine was 390°–420° F. A vacuum was pulled on the melt mass of no less than 3 inches mercury. The melt temperatures through the extruder was maintained at the following temperature settings:

| | |
|---|---|
| Barrel Zone No. 1 | 220–230° C. |
| Barrel Zone No. 2 | 220–230° C. |
| Barrel Zone No. 3 | 215–225° C. |
| Barrel Zone No. 4 | 200–210° C. |
| Barrel Zone No. 5 | 185–195° C. |
| Die Zone No. 6 | 175–185° C. |
| Die Zone No. 7 | 175–185° C. |
| Die Zone No. 8 | 175–185° C. |

The screw heater oil stream was maintained at 180°–190° C. The material was extruded at a line speed maintained between 5 and 7 ft./min.

Lengths of the sill, shown in FIGS. 1 and 2, were manufactured and tested for compression load, cross grain screw retention, longitudinal screw retention, thermal transmittance, and cleave strength of welded 90° mitered joints. The following Tables display the test data developed in these experiments.

Compression and Screw Retention

Products Tested

Reclaimed Composite material (40% sawdust, pine, 60% PVC) extruded into FIG. 1 shape.

Purpose of Test

Determine maximum compression load, cross-grain screw retention and longitudinal screw retention.

| | Compression Load (lbs) FIG. 1 | Cross Grain Screw Retention (lbs) FIG. 2 | Longitudinal Screw Retention (lbs) FIG. 3 |
|---|---|---|---|
| Sill of FIG. 1 | 2309.0 | 407.4 | 680.7 |
| Pine | 1980.0 | 85.5 | 613.0 |

Method of Testing

Materials were extruded to the sill in FIG. 1.

Compression preparation and testing was done according to ASTM D143 sec. 79. The 22480.0 lb. load cell was used with a testing rate of 0.012 in/min to a maximum displacement of 0.1 in.

Screw retention preparation and testing was done according to ASTM D1761. The 2248.0 lb load cell was used with a testing rate of 0.01 in/min.

Thermal Properties

Purpose of Test

Evaluate the thermal transmittance of the sill component of FIG. 1, relative to the standard pine material, by monitoring interior subsill surface temperatures when the door exterior is exposed to cold temperature.

Method of Testing

The reclaimed composite sill was extruded to the profile indicated in FIG. 1. The material consists of a 40/60 wt-% sawdust/PVC mixture.

A 46½" length of the reclaimed composite sill was used to replace one-half of the standard pine sill installed in the opening of the wind tunnel cold box. Installation flanges were fastened to the rough opening with duct tape. Fiberglass insulation was installed around the head and side jambs. Silicone sealant was applied beneath the sill and ¾" lumber was used as an interior trim at the head and side jambs.

Conclusion

The interior surface of the composite sill is about 2° F. colder than a pine sill (see FIG. 2) when the exterior temperatures is −10° F. and a normal room temperature is maintained.

Neither pine nor the composite sill exhibited condensation at an interior relative humidity of about 25%.

Weld Cleave Strength

| Part Description | Material | Wall Thickness | Cleave Strength in./lb. (s.d.) |
|---|---|---|---|
| Sill | PVC (100%) | .150" | 1178 (38) |
| Sill | 60/40 PVC/Sawdust | .150" | 441 (9) |
| Typical Hollow PVC Sash | PVC | .080" | 421 (85) |
| Modified Sill | 60/40 PVC Sawdust | .150" | 378 (47) |
| PERMASHIELD ® Casement Sash | PVC clad wood | .047" | 194 (33) |

The data that is set forth above shows that the composite sill manufactured from the polyvinyl chloride and the wood fiber composite material has a compression load cross grained screw retention and longitudinal screw retention superior to that of typical pine used in window manufacture. Further, the thermal transmittance of the composite material in a sill format appears to be approximately equal to that of pine even though there is about a 2° cooler interior surface temperature maintained when the interior/exterior temperature differential is about 90° F. Such thermal performance is approximately equal to that of pine but substantially better than that of aluminum.

A 90° mitered joint manufactured using the melt weld fused process set forth above, was manufactured using the composite of this invention using 60% polyvinyl chloride and 40% sawdust. The composites were compared with polyvinyl chloride, neat extrudate and polyvinyl chloride clad wood casement sash. Both low modulus (350,000 psi) and high modulus (950,000 psi) composite had a joint strength substantially greater than that of commonly available polyvinyl chloride clad wood members using commercially available casement sash. The strength was approximately equal to that of typical hollow PVC-sash but was not as good as a sill manufactured from a 100% polyvinyl chloride. This data shows that the composite material of the invention can form a weld joint with a strength substantially greater than that of commercially available window component materials. While the above discussion, examples and data provide a means for understanding the invention, the invention can be made in a variety of formats. Accordingly, the invention is found in the claims hereinafter appended.

We claim:

1. A structural member comprising a polymer and wood fiber composite, suitable for use as a structural member in the manufacture of a window or a door, which structural member comprises an extruded or injection molded hollow profile having a defined support direction, wherein the compressive strength of the member in the defined support direction is greater than about 1500 psi, the composite comprising a continuous phase comprising a polyvinyl chloride and an effective amount of a wood fiber dispersed in the continuous phase to provide structural properties similar or superior to those of wooden members, and wherein the polyvinyl chloride phase thoroughly wets and penetrates the wood fiber.

2. The structural member of claim 1 wherein there is at least one support web contained within the hollow profile.

3. The structural member of claim 1 wherein there is at least one fastener anchor web.

4. The structural member of claim 1 wherein the structural member has a Youngs modulus of at least about 500,000 psi.

5. The structural member of claim 1 which is selected from the group consisting of a sill, a jamb, a stile or a rail.

6. A structural unit comprising at least two structural members of claim 1 fixed together at a secure joint.

7. The structural unit of claim 6 wherein the joint is formed by thermal welding.

8. The structural member of claim 1 wherein the compressive strength is greater than 2000 psi.

9. A structural member suitable for use in a window or door, which member comprises a hollow profile having a rough opening mounting face, a shaped face adapted for a moveable window or door component and formed within the hollow profile is at least one support web and at least one fastener anchor web, wherein the compressive strength of the member, in a defined load direction, is greater than about 1500 psi, the composite comprising a continuous phase comprising a polyvinyl chloride and an effective amount of a wood fiber dispersed in a continuous phase to provide structural properties similar or superior to those of wooden members, wherein the polyvinyl chloride phase thoroughly wets and penetrates the wood fiber.

10. The structural member of claim 9 wherein there is at least two support webs contained within the hollow profile.

11. The structural member of claim 9 wherein there is at least two fastener anchor webs.

12. The structural member of claim 9 wherein the structural member has a Youngs modulus of at least about 500,000 psi.

13. The structural member of claim 9 which is selected from the group consisting of a sill, a jamb, a stile or a rail.

14. The structural unit comprising at least two structural members of claim 9 fixed together at a secure joint.

15. The structural unit of claim 14 wherein the joint is formed by thermal welding.

16. The structural member of claim 9 wherein the compressive strength is greater than 2000 psi.

* * * * *